US005462431A

United States Patent [19]

Ahmady

[11] Patent Number: 5,462,431

[45] Date of Patent: Oct. 31, 1995

[54] IGNITOR WITH METERING ORIFICE INSERT

[75] Inventor: Farshid Ahmady, Rochester Hills, Mich.

[73] Assignee: Solaronics, Rochester, Mich.

[21] Appl. No.: 225,704

[22] Filed: Apr. 11, 1994

[51] Int. Cl.[6] ..... F23Q 7/22

[52] U.S. Cl. ..... 431/43; 431/264; 431/283; 126/406

[58] Field of Search ..... 431/264, 42, 43, 431/353, 283; 126/406; 123/145 A

[56] References Cited

U.S. PATENT DOCUMENTS 3,441,360 4/1969 Johnson ..... 126/406 X
3,645,511 2/1972 Alms et al. ..... 431/283 X
4,534,728 8/1985 Vogels ..... 431/80
4,744,748 5/1988 Raines ..... 431/353

*Primary Examiner*—Larry Jones
*Attorney, Agent, or Firm*—Young, MacFarlane & Wood

[57] ABSTRACT

A fuel enriched ignitor for a fuel gas burner appliance wherein a fuel enricher tube is provided with a coupling having a threaded insert which, by way of a metering orifice, matches the enricher tube to the particular fuel gas being used. By both two-element and three-element ignitors are disclosed. The ignitor is also illustrated in a gas supply system having a single main valve which serves both the enricher tube and the primary appliance burner.

6 Claims, 2 Drawing Sheets

FIG-1
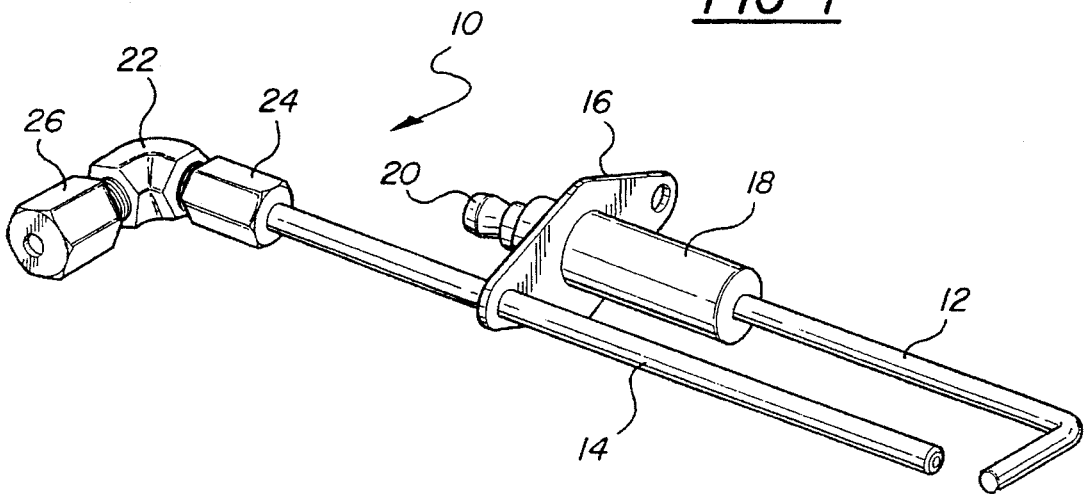
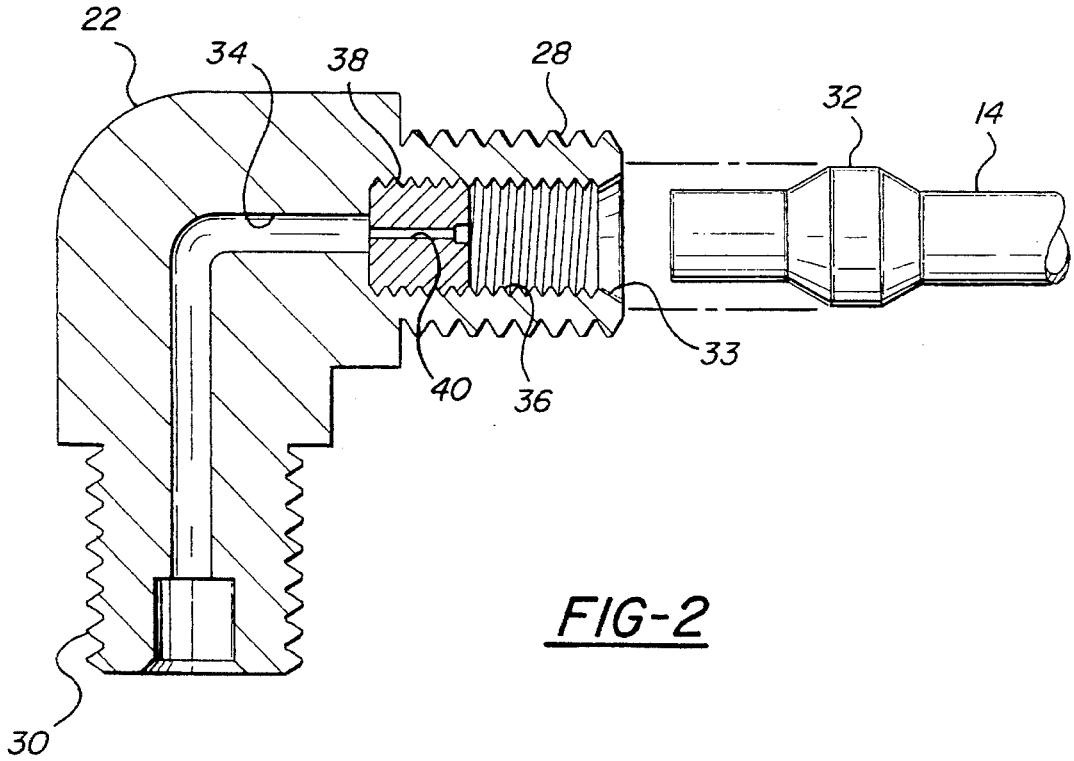
FIG-2

IGNITOR WITH METERING ORIFICE INSERT

FIELD OF THE INVENTION

This invention relates to fuel-gas enriched ignitors for fuel gas burners and more particularly to the provision of a coupling for such ignitors which permits a single-design ignitor structure to be utilized for different types of fuel gas; for example, propane and natural gas, and which permits the ignitor to be connected directly to the main gas supply valve.

BACKGROUND OF THE INVENTION

Gas fired burners for industrial applications such as deep fryers and ovens typically utilize multiple electrode ignitors to create a spark discharge in a fuel rich area. It is known to fabricate one of the electrodes in the form of a hollow tube and connect that electrode to a fuel line so as to enrich the fuel:air ratio in the immediate vicinity of the spark discharge, thus to enhance the prospects for successful ignition.

A problem associated with fuel gas enriched ignitors of the type described above is the necessity of matching the flow metering characteristics of a hollow electrode to the fuel gas being used; i.e., propane requires a different size metering orifice than natural gas. The known solution is to permanently incorporate a metering orifice into the base of the tubular electrode and assign the device to a single type of fuel. Obviously, this requires the manufacturer or service personnel to inventory at least two different ignitor structures and to label or otherwise segregate the devices so as to avoid inadvertent use of the wrong ignitor in any given situation.

Another problem associated with presently available fuel gas enriched ignitors is the sensing of the enricher flame. The sensor first senses the flame produced by the enricher then sends a signal to the power source to open the main valve for the main burner to ignite. Unless the enricher flame is a large flame, the sensor does not recognize the-flame and the main burner never turns on. To operate properly, a larger metering orifice is used to produce a larger flame. This obviously increases the gas consumption and operating cost and results in waste of unnecessary energy. The existing system also requires an additional solenoid valve dedicated to the electrode which results in higher cost. More important, the sequence of operation takes a longer time due to the extra step in sensing.

SUMMARY OF THE INVENTION

In accordance with the present invention a coupling is provided for use in combination with a multiple electrode ignitor of the type in which one of the electrodes takes the form of a hollow tube to provide an enriched fuel/air ratio in the ignition area. In accordance with the invention, the coupling is formed of a solid body of appropriate material such as metal or a metal alloy, exhibits two opposite and externally threaded ends for receiving standard gas line fittings and exhibits a through bore so that fuel gas may be supplied through the coupling to a hollow tubular electrode. In accordance with the invention, the through bore of the coupling is internally threaded over a length immediately adjacent and contiguous with one of the ends thereby to receive an externally threaded insert having a metering orifice formed therethrough in accordance with the fuel with which the coupling is to be used. In addition, the orifice insert is provided with a simple expedient such as an end slot to receive a screwdriver blade thereby to permit the insert to be inserted into and removed from the internally threaded length of the coupling bore.

Through this instrumentality, metering orifice inserts of two different types can be carried in inventory by either OEM or service personnel and quickly threaded into a coupling for attachment to and between the fuel line and the hollow tubular electrode, the metering orifice insert being selected to provide appropriate flow characteristics according to the type of fuel being used. The ignitor itself may, as a result, be of a single design regardless of the type of fuel contemplated. Moreover, an installed ignitor may be simply switched from one fuel type to another by means of a quick and easy operation in the field. In particular, the coupling is detached from the electrode, the metering insert removed with a small screwdriver, a new metering insert put in its place and the system reassembled for normal operation. Adjustment for a revised or substitute fuel gas situation is achieved in a matter of minutes.

When the system is energized, the main valve opens, gas travels simultaneously to both the main burner and the enricher tube, the spark ignites the enricher flame and the main burner. The sensor senses the flame and sends a signal back to the power source to keep the main valve open. The need for an extra solenoid valve is eliminated since the enricher tube is fed directly by the main valve. The sensor senses the main burner and not the enricher flame therefore the enricher flame can be as small as possible with a small metering orifice (about 200 BTUH).

These and other advantages of the present invention may be best understood by reference to the following specification which is to be taken with the accompanying drawings in which:

BRIEF DESCRIPTION OF THE DRAWING

FIG. 1 is a perspective view of a first embodiment of the invention in the form of a two-component ignitor;

FIG. 2 is a detail of the ignitor of FIG. 1 showing the coupling and insert of the present invention in cross section;

DETAILED DESCRIPTION OF THE ILLUSTRATIVE EMBODIMENTS

Figure 3:
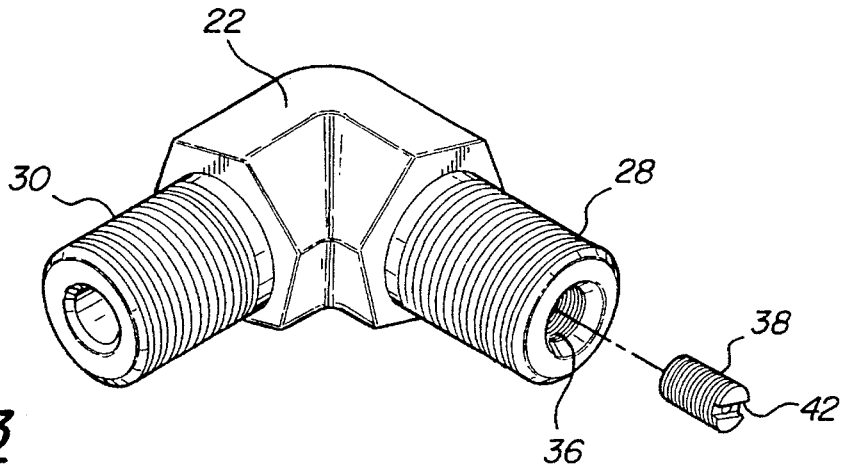
FIG. 3 is a perspective view of the coupling and insert of FIG. 2.

In FIG. 1, a two-component electronic ignitor 10 is shown to comprise an ignitor electrode 12 and an enricher tube electrode 14, the electrodes 12 and 14 being mounted in spaced relation by way of a metal stamping 16. A cylindrical ceramic insulator 18 surrounding electrode 12 and being disposed between the electrode 12 and the stamping 16 provides electrical isolation between the electrodes 12 and 14. Electrode 12 is provided with a conventional terminal 20 for connection to a power supply as hereinafter described and serves in this embodiment the dual role of ignitor and flame sensor.

Enricher tube electrode 14 is connected to an L-shaped coupling 22 having conventional threaded compression fittings 24 and 26 disposed on externally threaded end portions 28 and 30. Enricher tube electrode 14, which is hollow throughout its length, is provided with a compression fitting ferrule 32 which mates with the counter-sunk portion 33 of a through bore 34 which extends throughout the coupling 22 from one end to the other. Adjacent and within the threaded end 28 of the through bore 34 is an internally threaded portion 36 into which is disposed in threaded relation an insert 38 having formed therethrough a metering orifice 40 which matches the coupling 22 to the particular fuel from the fuel supply; e.g., natural gas or propane.

The coupling 22 as described above and shown in FIGS. 1, 2 and 3 is used for the purpose of coupling the fuel enricher tube electrode 14 to a fuel gas supply so as to enrich the ratio of gas to air in the immediate vicinity of the ignitor electrodes as shown in FIG. 1. The coupling 22 may be standardized for all types of fuel and tailored either by the OEM or in the field to the specific fuel by insertion of the proper insert 38 into the internally threaded portion 36 of the coupling 22 before connecting the enricher tube electrode 14 to the coupling by way of the compression fitting 24. It will be understood that a second compression fitting 26 is threaded onto a threaded end 30 to connect the coupling to the main valve of a fuel supply as hereinafter described with reference to FIG. 5.

As best shown in FIG. 3, the insert 38 is preferably provided with a slot 42 in one end to accommodate the blade of a screwdriver for purposes of installing and removing the insert 38 from the coupling 22.

Figure 4:
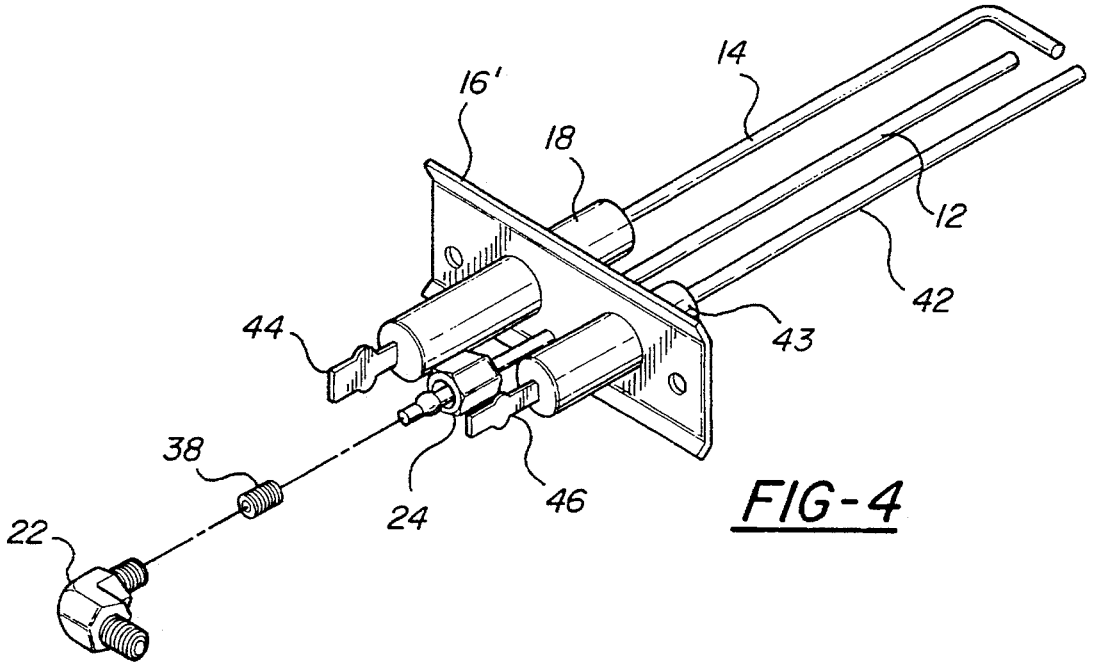
FIG. 4 is a perspective drawing of a second embodiment of the invention in the form of a three-component ignitor.

FIG. 4 illustrates a second and alternative embodiment of the invention wherein components which are similar or identical to those of the embodiment of FIG. 1 are identified with like reference numerals. The embodiment of FIG. 4 comprises, in addition to the ignitor electrode 12 and the enricher tube electrode 14, a separate flame sensor electrode 42 which is disposed in parallel spaced relationship to the other two electrodes. A cylindrical ceramic insulator 43 electrically isolates the electrode 42 from the other two electrodes and from a metal stamping 16' which is used for purposes of mounting the ignitor structure. Electrodes 14 and 42 have electrical terminals 44 and 46 for connection to a power supply as hereinafter described.

Figure 5:
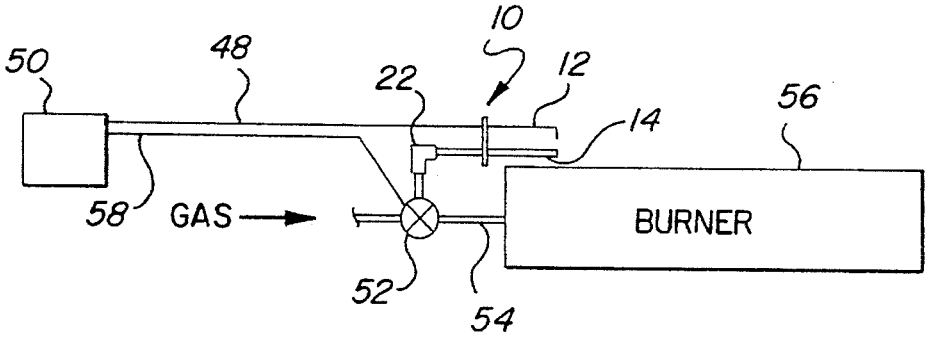
FIG. 5 is a schematic diagram of a fuel gas supply and ignition system for a gas-burning appliance utilizing the subject invention.

FIG. 5 illustrates the arrangement of the ignitor 10 of FIG. 1 in a fuel gas supply and ignition system for a gas-burning appliance having a burner 56. The top line of the rectangle numbered 56 is the active surface of the burner; i.e., the flame extends upwardly toward the ignitor electrodes. In FIG. 5, the ignitor electrode 12 is connected by way of a conductor 48 to a power output of a conventional power supply 50. A signal output 58 of the power supply is connected by way of a suitable conductor 58 to an electronically controllable main supply valve 52 which serves to couple a primary fuel gas supply to a main supply line 54 of the burner 56 as well as to the coupling 22 which is connected to the enricher tube electrode 14.

When the system of FIG. 5 is energized, the main valve 52 opens and gas travels simultaneously to both the main burner 56 and the enricher tube 14. The power supply 50 applies current through conductor 48 to the ignitor 12 and ignites both the enricher tube flame and the main burner flame at the same time. The sensor electrode which, in the arrangement of FIG. 1 also serves as the ignitor electrode 12, senses the flame and sends a signal back to the power supply to keep the main valve 52 open. The need for an extra solenoid valve is therefore eliminated since the enricher tube 14 is fed directly by the main valve 52. The sensor electrode 12 (or 42 in the embodiment of FIG. 4) senses the main burner and not the enricher flame and therefore the enricher flame can be as small as possible; i.e., a metering insert 38 having a very small, energy-thrifty through bore 40 can be used. It is to be understood that the drawing of FIG. 5 has been made with the ignitor 10 out of its normal orientation; i.e., the ignitor 10 has been rotated 90 degrees about its own longitudinal axis to better show the electrode gap. In this orientation, the sensor electrode 12 sees only the flame from burner 56.

In a ⅛ inch I.D. coupling, the metering orifice is 0.003 inch for liquid petroleum and is 0.005 inch for natural gas.

I claim:

1. For use in combination with a fuel gas ignitor of the type having a hollow tubular first electrode connectable to a fuel gas supply line and a solid second electrode disposed in spaced relationship with the first electrode to ignite fuel gas supplied to a gas enriched area between said electrodes;

a coupling for attaching said first electrode to said supply line comprising a solid body having first and second opposite and externally threaded end portions, a bore extending through said body and between said end portions, a length of bore adjacent one said end portion being internally threaded; and a first and a second fuel gas metering insert, each having external threads for engagement with the internal threads of said length and alternatively insertable therein, said first insert having a through bore forming a metering orifice sized to supply a predetermined amount of a first type of fuel gas to said first electrode when inserted in said coupling bore and said second insert having a through bore forming a metering orifice sized to supply a predetermined amount of a second type of fuel gas to said first electrode when inserted in said coupling bore, said inserts further having means formed therein for facilitating insertion and removal thereof relative to said coupling body;

whereby said fuel gas ignitor is modifiable to function properly when supplied with either said first or said second type of fuel gas by the alternative insertion in said coupling of said first or said second insert respectively.

2. Apparatus as defined in claim 1 wherein the diameter of said length is greater than the diameter of said coupling through bore thereby to form an internal shoulder at which said internal threads are effectively terminated, said length being at least as great as the overall length of said insert whereby said insert is wholly disposed within said length.

3. Apparatus as defined in claim 2 wherein said coupling body is L-shaped.

4. Apparatus as defined in claim 3 wherein said coupling body is made of metal.

5. A fuel gas ignitor for creating and igniting a gas enriched area within a gas fired burner, comprising:

a hollow tubular first electrode connectable to a fuel gas supply line;

a solid second electrode disposed in spaced relationship with the first electrode to ignite fuel gas supplied by said first electrode to form said gas enriched area between said electrodes;

a coupling attaching said first electrode to said supply line comprising a solid body having first and second opposite and externally threaded end portions, a bore extending through said body and between said end portions, a length of bore adjacent one said end portion being internally threaded; and a first and a second fuel gas metering insert, each having external threads for engagement with the internal threads of said length and alternatively insertable therein, said first insert having a through bore forming a metering orifice sized to supply a predetermined amount of a first type of fuel gas to said first electrode when inserted in said coupling bore and said second insert having a through bore forming a metering orifice sized to supply a predetermined amount of a second type of fuel gas to said first electrode when inserted in said coupling bore;

whereby said fuel gas ignitor is modifiable to function properly when supplied with either said first or said second type of fuel gas by the alternative insertion in said coupling of said first or said second insert respectively.

6. A method of adapting a fuel gas ignitor of a gas fired burner to function properly when supplied with either of a first type or a second type of fuel gas, the fuel gas ignitor being of the type having a hollow tubular first electrode connectable to a fuel gas supply line and a solid second electrode disposed in spaced relationship with the first electrode to ignite fuel gas supplied to a gas enriched area between said electrodes, the method comprising:

attaching said first electrode to said supply line with a coupling comprising a solid body having first and second opposite and externally threaded end portions, a bore extending through said body and between said end portions, a length of bore adjacent one said end portion being internally threaded; and providing a first and a second fuel gas metering insert, each having external threads for engagement with the internal threads of said length and alternatively insertable therein, said first insert having a through bore forming a metering orifice sized to supply a predetermined amount of said first type of fuel gas to said first electrode when inserted in said coupling bore and said second insert having a through bore forming a metering orifice sized to supply a predetermined amount of said second type of fuel gas to said first electrode when inserted in said coupling bore.

* * * * *